US007780423B2

(12) United States Patent
Liang

(10) Patent No.: US 7,780,423 B2
(45) Date of Patent: Aug. 24, 2010

(54) BLOWER

(75) Inventor: Hesheng Liang, Zhong Shan (CN)

(73) Assignee: Sun Pleasure Company, Ltd., Hong Kong (HK)

( * ) Notice: Subject to any disclaimer, the term of this patent is extended or adjusted under 35 U.S.C. 154(b) by 845 days.

(21) Appl. No.: 11/264,276

(22) Filed: Nov. 1, 2005

(65) Prior Publication Data

US 2006/0093500 A1 May 4, 2006

(51) Int. Cl.
*F04B 17/00* (2006.01)

(52) U.S. Cl. ..... 417/423.15; 417/423.9

(58) Field of Classification Search ..... 417/53, 417/423.1, 423.9, 423.15; 248/176.2, 176.1; 416/244 R; 403/383; 15/327.1, 327.6, 353, 15/412

See application file for complete search history.

(56) References Cited

U.S. PATENT DOCUMENTS 1,767,535 A * 6/1930 Lannert et al. ..... 417/361
1,883,288 A * 10/1932 Zubaty ..... 310/62
4,194,338 A * 3/1980 Trafton ..... 403/305
4,538,967 A * 9/1985 Furukawa ..... 417/360
4,880,364 A * 11/1989 Berfield et al. ..... 417/423.1
5,133,617 A * 7/1992 Sokn et al. ..... 403/349
5,375,651 A * 12/1994 Colwell ..... 165/47
5,425,902 A * 6/1995 Miller et al. ..... 261/128
5,480,170 A * 1/1996 Kaiser, II ..... 280/30
5,555,647 A * 9/1996 Torborg et al. ..... 34/601
5,974,623 A * 11/1999 Cummins et al. ..... 15/347
6,581,894 B1 * 6/2003 Tong ..... 248/314
6,802,699 B2 * 10/2004 Mikami et al. ..... 417/369
2003/0035735 A1 * 2/2003 Wang et al. ..... 417/234
2005/0047945 A1 * 3/2005 Metzger ..... 417/423.14

* cited by examiner

*Primary Examiner*—Devon C Kramer
*Assistant Examiner*—Dnyanesh Kasture
(74) *Attorney, Agent, or Firm*—Raymond Sun

(57) ABSTRACT

A blower has an air channel housing that defines an air channel therein, the air channel housing having an air outlet extending therefrom. A plurality of air blades are positioned inside the air channel housing, and positioned horizontally with respect to a surface on which the blower is supported. A base seat is positioned below the air channel housing, the base seat having a side wall, with an air inlet provided in the side wall. A motor is positioned in the base seat and has a shaft that extends through the air channel housing to be coupled to the air blades.

10 Claims, 3 Drawing Sheets

BLOWER

BACKGROUND OF THE INVENTION

1. Field of the Invention

The present invention relates to a blower.

2. Description of the Prior Art

A conventional blower is typically oriented so that the plane of its body stands vertically during use. The conventional blower typically includes an electric motor, air blades, and a centrifugal air channel. The air blades are oriented vertically in the air channel. The electric motor is positioned on one side of the air channel, and an air inlet is formed at the other side. When the power is turned on, the electric motor drives the air blades to rotate. After the air blades draw in air from the air inlet, the air is blown out through the air outlet of the air channel.

Unfortunately, this configuration for a conventional blower suffers from some drawbacks, which include a high center of gravity, fast heating of the electric motor, slow heat dissipation, and appreciable wear and loss, which often results in a short service life for the blower. In addition, the vertical orientation of the conventional blower can be dangerous because the blower can be inadvertently tipped or toppled during use.

SUMMARY OF THE DISCLOSURE

It is an object of the present invention to provide a blower that can be used safely, and which enjoys a long service life.

In order to accomplish the objects of the present invention, the present invention provides a blower that is supported on a surface. The blower has an air channel housing that defines an air channel therein, the air channel housing having an air outlet extending therefrom. A plurality of air blades are positioned inside the air channel housing, and positioned horizontally with respect to the surface. A base seat is positioned below the air channel housing, the base seat having a side wall, with an air inlet provided in the side wall. A motor is positioned in the base seat and has a shaft that extends through the air channel housing to be coupled to the air blades.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
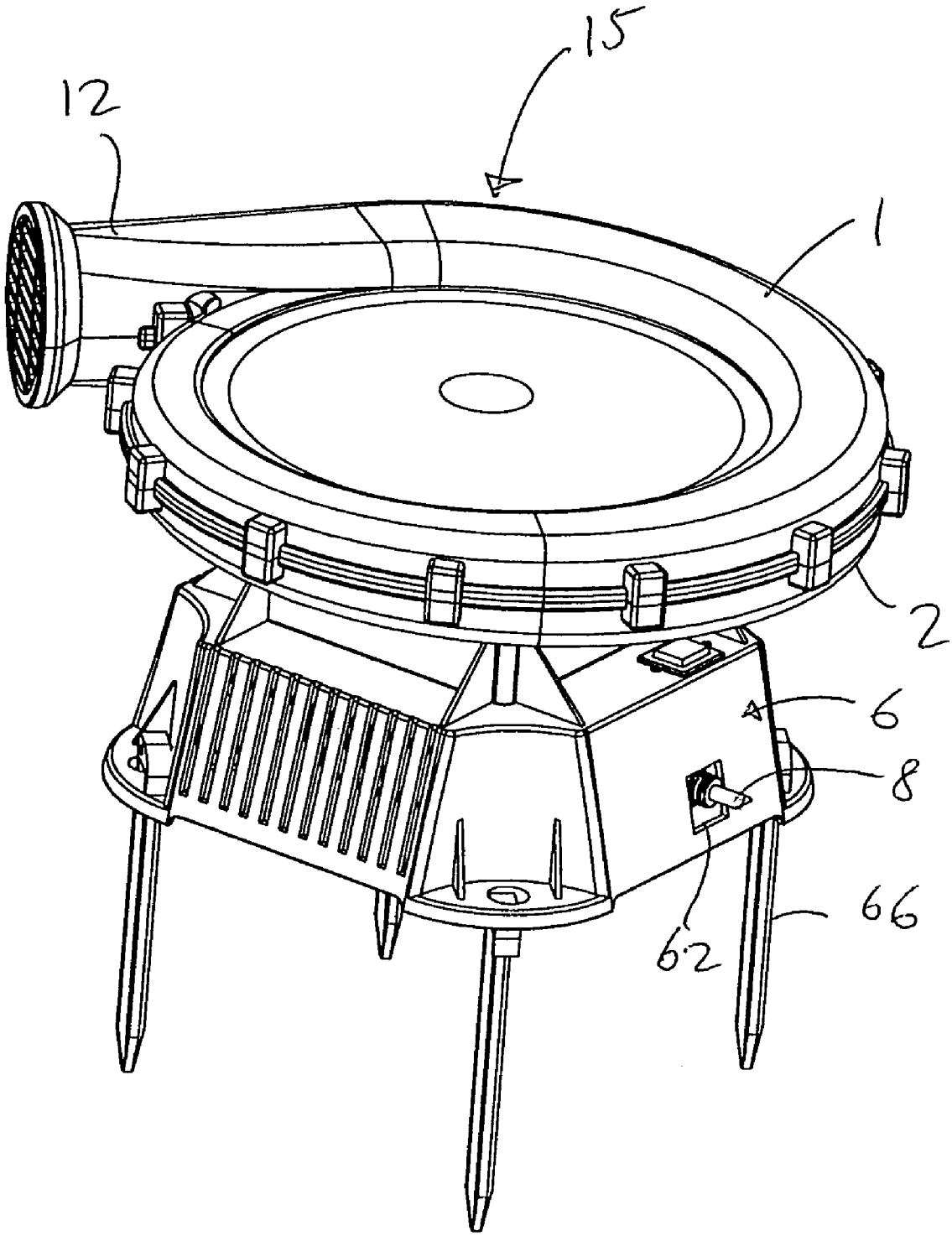
FIG. 1 is a perspective view of a blower according to one embodiment of the present invention.
Figure 2:
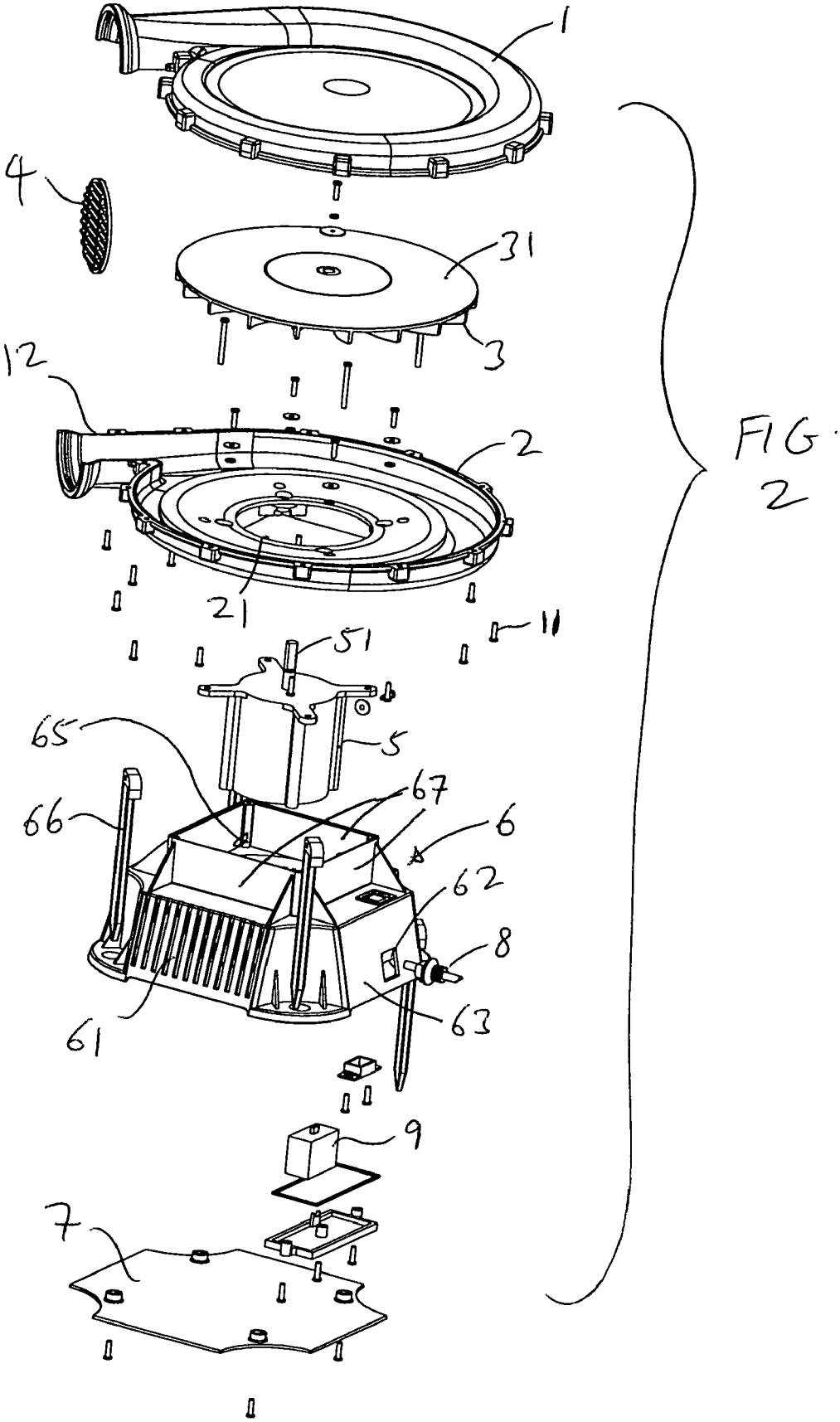
FIG. 2 is an exploded top perspective view of the blower of FIG. 1.
Figure 3:
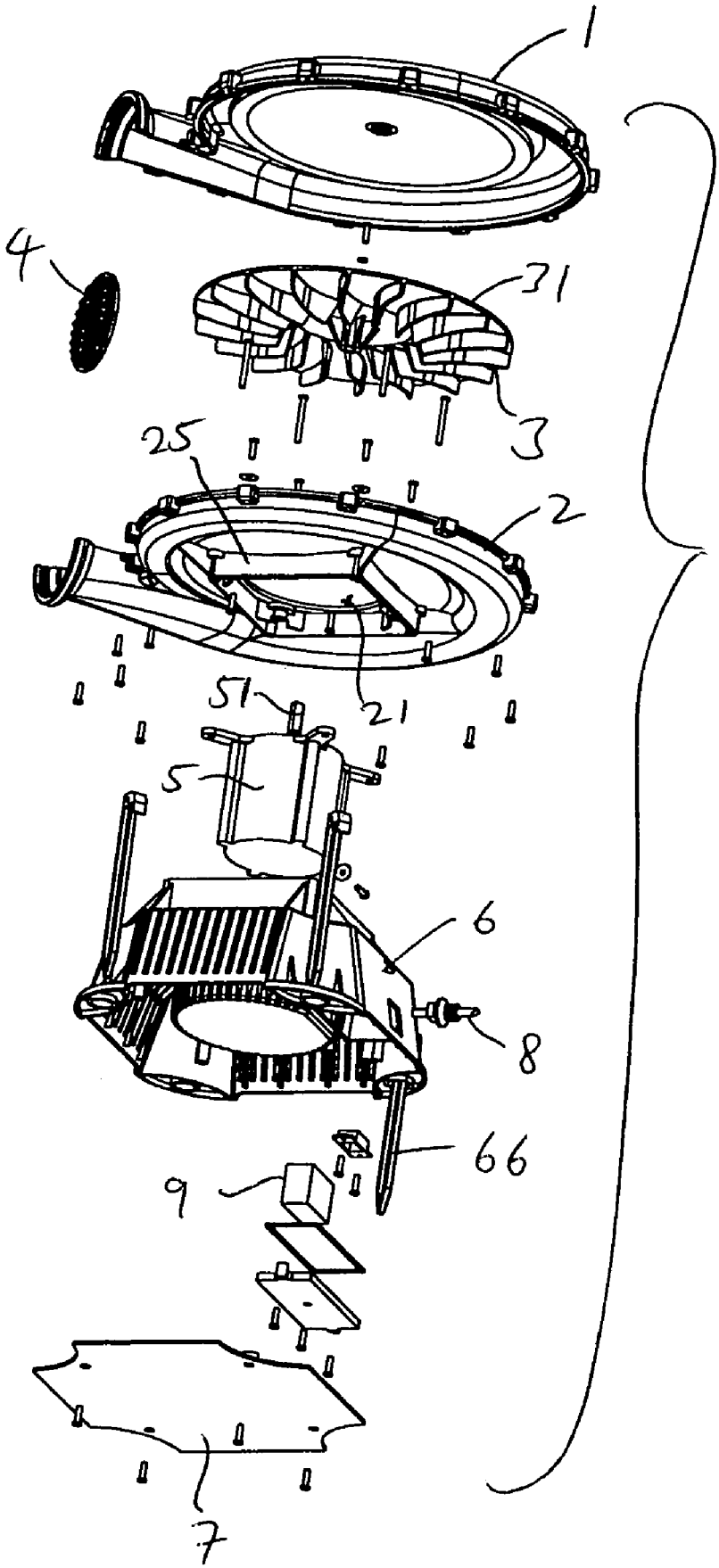
FIG. 3 is an exploded bottom perspective view of the blower of FIG. 1.

Referring to FIGS. 1-3, a blower according to the present invention has a base seat 6 that is mounted on a base plate 7. A capacitor 9 is provided inside the base seat 6, and is electrically coupled to a switch 8 that extends through an opening 62 in a side wall 63 of the base seat 6. An air inlet 61 is provided in one or more side walls 64 of the base seat 6. The base seat 6 also has an accommodation space 65 that is defined by four walls 67. The accommodation space 65 holds an electric motor 5. The motor 5 is coupled to the switch 8 and the capacitor 9 by wires (not shown). A plurality of stakes 66 are optional depending upon the location where the blower is intended to be used. For example, the stakes 66 can be omitted when the blower is used indoors, but if the blower is intended to be used outdoors, the stakes 66 can be extended through openings in the base seat 6 to elevate the blower to a vertical level that is slightly above the ground. As a result, the base seat 6 can be elevated from the ground to prevent water, dirt or other particles from entering the interior of the base seat 6.

An air channel housing 15 is positioned above the base seat 6 and the motor 5. The air channel housing 15 can be formed by an inner lid 2 and an outer lid 1 that can be secured together by screws 11. The space between the lids 1 and 2 defines an air channel, and the resulting air channel has a generally round configuration with an air outlet 12 extending from the housing 15. When the blower is deployed for use, the plane of the lids 1, 2 (i.e., the housing 15) is generally horizontal with respect to the ground. Air blades 3 are positioned on a blade plate 31, which is positioned inside the air channel between the lids 1 and 2. More specifically, the motor 5 has a shaft 51 which is coupled to the center of the base plate 31 to cause the base plate 31 (and the blades 3 carried thereon) to rotate when the motor 5 is turned on. The inner lid 2 is secured above the base seat 6 and the motor 5 by fitting the walls 67 of the base seat 6 into a mount 25 provided on the lower surface of the inner lid 2. The inner lid 2 has a central opening 21 that is aligned with the motor 5, with the central opening 21 acting as an air suction opening.

The air flow for the blower is as follows. Air enters the space between the inner wall of the base seat 6 and the electric motor 5 through the air inlet 61. The air is then drawn into the air channel via the central opening 21 by rotation of the air blades 3. The air in the air channel is then directed towards the air outlet 12, and passes through a protective screen 4 before exiting the air outlet 12.

The construction of the blower of the present invention results in the following:

1. A simplified construction.

2. The electric motor 5 can be set at a relatively low position to lower the center of gravity of the entire blower so that the blower will not topple or be tipped as easily, thereby improving the safety.

3. The air is drawn in through the air inlet 61 to first pass through the electric motor 5 and then enter the air channel. Thus, when the electric motor 5 is turned on, the air entering through the air inlet 61 flows by the surface of the electric motor 5 to cool it off. Thus, the temperature of the electric motor 5 can be lowered effectively, and the efficiency of the electric motor 5 can be increased, thereby saving energy and extending the service life of the electric motor 5.

4. The base seat 6 that is used for installing the electric motor 5 is positioned below the air channel, thereby lowering the center of gravity of the blower (to avoid tipping) and protecting the motor 5 from external objects and the other components of the blower.

5. The air inlet 61 is formed on a side wall of the base seat 6. This positioning protects the motor 5 from water, grass, dirt and other particles.

6. The air blades 3 are positioned horizontally when the blower is in use, thereby allowing the center of gravity of the blower to be lowered.

7. Both the air inlet 61 and the electric motor 5 are positioned on the same side of the air channel, which allows incoming air to be passed around the motor 5 to cool the motor 5 before reaching the air channel.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A blower that is supported on a surface, comprising:

an air channel housing that defines an air channel therein, the air channel housing having a lower surface and an air outlet extending therefrom;

a mount extending from the lower surface of the air channel housing;

a plurality of air blades inside the air channel housing, and positioned horizontally with respect to the surface;

a base seat positioned below the air channel housing, the base seat having a side wall, with an air inlet provided in the side wall, the base seat further including four planar upper walls that define the borders of an accommodation space; and a motor positioned in the accommodation space and having a shaft that extends through the air channel housing to be coupled to the plurality of air blades;

wherein the upper walls of the base seat are fitted into the mount in a manner that is devoid of a sealing element and which prevents the air channel housing from rotating with respect to the base seat; and wherein a plurality of ribs extend from the base seat, and each rib is in direct contact with at least a portion of one of the upper walls.

2. The blower of claim 1, further including a plurality of stakes extending from the base seat.

3. The blower of claim 1, further including a protective screen provided at the air outlet.

4. The blower of claim 1, further including a blade plate that is coupled to the shaft of the motor, with the plurality of air blades carried on the blade plate.

5. The blower of claim 4, wherein the blade plate is oriented horizontally with respect to the surface.

6. The blower of claim 1, wherein the air inlet and the motor are positioned on the same side of the air channel.

7. A method of generating a stream of air, comprising:

a. providing a blower that is supported on a surface, the blower having:

an air channel housing that defines an air channel therein, the air channel housing having a lower surface and an air outlet extending therefrom;

a mount extending from the lower surface of the air channel housing;

a plurality of air blades inside the air channel housing;

a base seat positioned below the air channel housing, the base seat having a side wall, with an air inlet provided in the side wall, the base seat further including four planar upper walls that define the borders of an accommodation space; and a motor positioned in the accommodation space and having a shaft that extends through the air channel housing to be coupled to the plurality of air blades;

wherein the upper walls of the base seat are fitted into the mount in a manner that is devoid of a sealing element and which prevents the air channel housing from rotating with respect to the base seat; and wherein a plurality of ribs extend from the base seat, and each rib is in direct contact with at least a portion of one of the upper walls;

b. drawing air through the air inlet;

c. passing the drawn air through the motor before delivering the air to the air channel; and d. directing the air from the air channel out of the air outlet.

8. The method of claim 7, further including:

orienting the air channel housing and the plurality of air blades in a horizontal position with respect to the surface.

9. A blower that is supported on a surface, comprising:

an air channel housing that defines an air channel therein, the air channel housing having a lower surface and an air outlet extending therefrom;

a mount extending from the lower surface of the air channel housing;

a plurality of air blades inside the air channel housing;

a base seat positioned below the air channel housing, the base seat having a side wall, with an air inlet provided in the side wall, the base seat further including four planar upper walls that define the borders of an accommodation space; and a motor positioned in the accommodation space and having a shaft that extends through the air channel housing to be coupled to the plurality of air blades;

wherein the blower has an air flow path that begins from the air inlet, extends past the motor to the interior of the air channel housing, and exits through the air outlet, and wherein the upper walls of the base seat are fitted into the mount in a manner that is devoid of a sealing element and which prevents the air channel housing from rotating with respect to the base seat; and wherein a plurality of ribs extend from the base seat, and each rib is in direct contact with at least a portion of one of the upper walls.

10. The blower of claim 9, wherein the air blades are positioned horizontally with respect to the surface.

* * * * *